United States Patent [19]

Bohanon, Sr.

[11] 4,389,352

[45] Jun. 21, 1983

[54] COOLING PAD SUPPORT ASSEMBLY

[75] Inventor: Hoy R. Bohanon, Sr., Muskogee, Okla.

[73] Assignee: Acme Engineering & Manufacturing Corporation, Muskogee, Okla.

[21] Appl. No.: 357,756

[22] Filed: Mar. 12, 1982

[51] Int. Cl.[3] ..... B01F 3/04

[52] U.S. Cl. ..... 261/106; 261/DIG. 41; 55/508

[58] Field of Search ..... 261/106, DIG. 41; 55/508, 511

[56] References Cited

U.S. PATENT DOCUMENTS

| | | | |
|---|---|---|---|
| 2,268,540 | 1/1942 | Andrews | 261/DIG. 15 |
| 2,850,269 | 9/1958 | Bohanon | 261/97 |
| 3,612,033 | 10/1971 | Chilcoat | 261/106 |
| 3,823,926 | 7/1974 | Bracich | 261/106 |
| 4,031,180 | 6/1977 | Bohanon | 261/DIG. 15 |
| 4,045,523 | 8/1977 | Goettl | 261/DIG. 41 |

*Primary Examiner*—Tim R. Miles

*Attorney, Agent, or Firm*—James D. Halsey

[57] ABSTRACT

A support assembly for a cooling pad evaporation system to be used in an opening within the wall of a building and having a water conductor provided with spaced openings in the top thereof, a cover for the water conductor which dissipates water completely over the top surface of the pad, a plurality of individually distinct cooling cells, and a gutter positioned below the pads. The cover is made up of two major structural pieces; one being the rear piece which is attached to the wall, and the other being a front piece with one end extending over and interlocking with a flange located on the top of the rear piece. Inside the cover is a top cover connector, which is an inverted "L"-shaped member providing a uniform surface for deflecting the upwardly directed water down onto the pads, water conductor support brackets and a water conductor. The lower gutter assembly contains a gutter support which is attached to the wall and has a flange extending at an angle toward the wall to catch the water descending the rear side of the cooling pad, and further contains a flange supporting only the rear corner of the cooling pad. The gutter, which hooks into the gutter support, contains a flange extending at an angle away from the wall for catching the water descending the front of the cooling pad, and a horizontal flange supporting only the front lower corner of the cooling pad. In addition, the gutter contains an area below these horizontal support flanges for collecting water; this area being lined by a gutter connector having a "U"-shaped member running the length of the gutter. The system also uses several ring-topped hooks as pad retainers when more than one pad is used.

10 Claims, 8 Drawing Figures

COOLING PAD SUPPORT ASSEMBLY

BACKGROUND OF THE INVENTION

The present invention relates to a support assembly for water evaporative cooling systems of the type that are used in greenhouses, poultry houses and livestock installations. Such cooling systems are installed within one or more of the walls of the building and utilize water soaked pads. The outside air is cooled as it passes into the building through a water soaked pad because of vaporization of the water. A pump is employed to supply water at controlled rates to a drip conductor positioned above the pad. The water drips downwardly from the conductor through the pad soaking same. Simultaneously, exhaust fans installed within the walls of the building create a negative pressure therein causing outside air to pass through the water soaked pad into the building thereby effecting the desired cooling of the incoming air. Excess water is collected below the pad in a gutter and thereafter pumped back to the drip conductor to continue the cooling operation.

Different types of support assemblies for water evaporation cooling pads are known in the art, for example:

U.S. Pat. No. 2,850,269 discloses a cooling pad hanger system comprising a top horizontal drip conductor having a cover and large drip orifices along its bottom, a hanger strip of sheet metal extending downwardly from the drip conductor along its rear, and a return drip collector under the cooling pads having flanges which hold frames surrounding the pads and catch descending water.

U.S. Pat. No. 2,268,540, discloses a furnace evaporative cooling unit having a water conduit surrounded partially by a cover. After running down the sides of the cooling pad, which is supported only at its lower corners, the water is captured by a water tank, one side of which has an outwardly extending flange.

U.S. Pat. No. 4,031,180 discloses an evaporation cooling system including a top cover over a water conductor, cooling pads and a bottom gutter. The top cover contains pad cover brackets provided with retainers located on opposite sides of the water conductor which terminate in flanges that hold the pads. A pan in the bottom gutter is provided with many openings and the flat bottoms of the cooling pads rest on the flat pan above these openings.

While such prior art support assemblies for evaporative cooling systems provide a means for cooling agricultural and poultry operations, a need exists to make such systems simpler in construction, and more economical and efficient in use. These goals can be achieved by a cooling pad support assembly which is:

1. easier to assemble;
2. easier to inspect and clean;
3. more efficient in promoting vaporization;
4. more constant and more uniform in inducing flow of water through the vaporization area;
5. more capable of facilitating an increase in the vaporization area height or length; and
6. more complete in insuring saturation of the top of the cooling pad.

SUMMARY OF THE INVENTION

Accordingly, it is a primary object of this invention to overcome the deficiencies of conventional cooling pad support assemblies used in evaporative cooling systems, including providing for simplicity in construction, economy, and efficiency, while maintaining all of the desirable features.

A specific object of this invention is to provide a support assembly whose parts easily interlock to facilitate assembly by the user.

It is another object of this invention to provide a support assembly whose parts are easily removed to facilitate inspection and cleaning.

It is another object of this invention to provide a support assembly which promotes efficient vaporization by allowing vaporization to occur only where it is designed to occur, i.e., at the cooling pads interfacing the air.

It is a further object of this invention to provide a support assembly which induces a constant and uniform flow of water through the vaporization area by not allowing water to collect in any one area.

It is still a further object of this invention to provide a support assembly which facilitates increasing the vaporization area in height or length by providing appropriate retainer assemblies for the use of additional cooling pads.

Finally, it is an object of this invention to provide a support mechanism which ensures complete saturation of the top and a small part of the sides of the cooling pad by surrounding the top and part of the sides of the cooling pad with a continuous cover.

To achieve the foregoing objects and in accordance with the purpose of the invention, as embodied and broadly described herein, the support assembly generally includes a water conduit, a cover assembly, cooling pads, and a gutter assembly. The cover is made up of two major structural pieces; one being the rear piece which is attached to the wall, and the other being the front piece with one end extending over and interlocking with a flange located on the top of the rear piece. Inside the cover are (1) top cover connectors, which are inverted "L"-shaped members providing a uniform surface for deflecting the upwardly-directed water onto the pads, (2) water conductor support brackets and (3) a water conductor. The gutter assembly contains gutter supports which are attached to the same wall and have a flange extending at an angle toward the wall (hereinafter inwardly) to catch the water descending the rear side of the cooling pad, and further contains a horizontal flange extending at an angle in a direction away from the wall (hereinafter outwardly) and supporting only the rear corner of the cooling pad. The gutter, which hooks into a groove in the gutter support, contains a flange extending outwardly at an angle for catching the water descending the front of the cooling pad, and a horizontal flange extending inwardly and supporting only the front lower corner of the cooling pad. In addition, the gutter assembly contains an area below the respective horizontal support flanges for collecting water lined by a "U"-shaped gutter connector running the length of the gutter. This system also uses several ring-topped hooks as pad retainers when more than one pad is used.

Since there are few parts to screw into the building wall, and since the parts interlock without further manipulation, the construction of the invention provides easier installation and maintenance.

Efficient recapture of descending water is also ensured through the use of the side flanges extending at an angle and the other horizontal flanges used to support only the lower corners of the pad. Thus, the bottom flat surface of the cooling pad is not completely resting on a flat gutter pan as in the prior art, thereby decreasing water collection in undesired areas and increasing water flow.

Further, this system for supporting individual cooling cells is specifically designed to permit ease in assembly and use at the installation site, and as well to permit the construction of a pad of the desired length and height.

DESCRIPTION OF THE PREFERRED EMBODIMENTS

Figure 1:
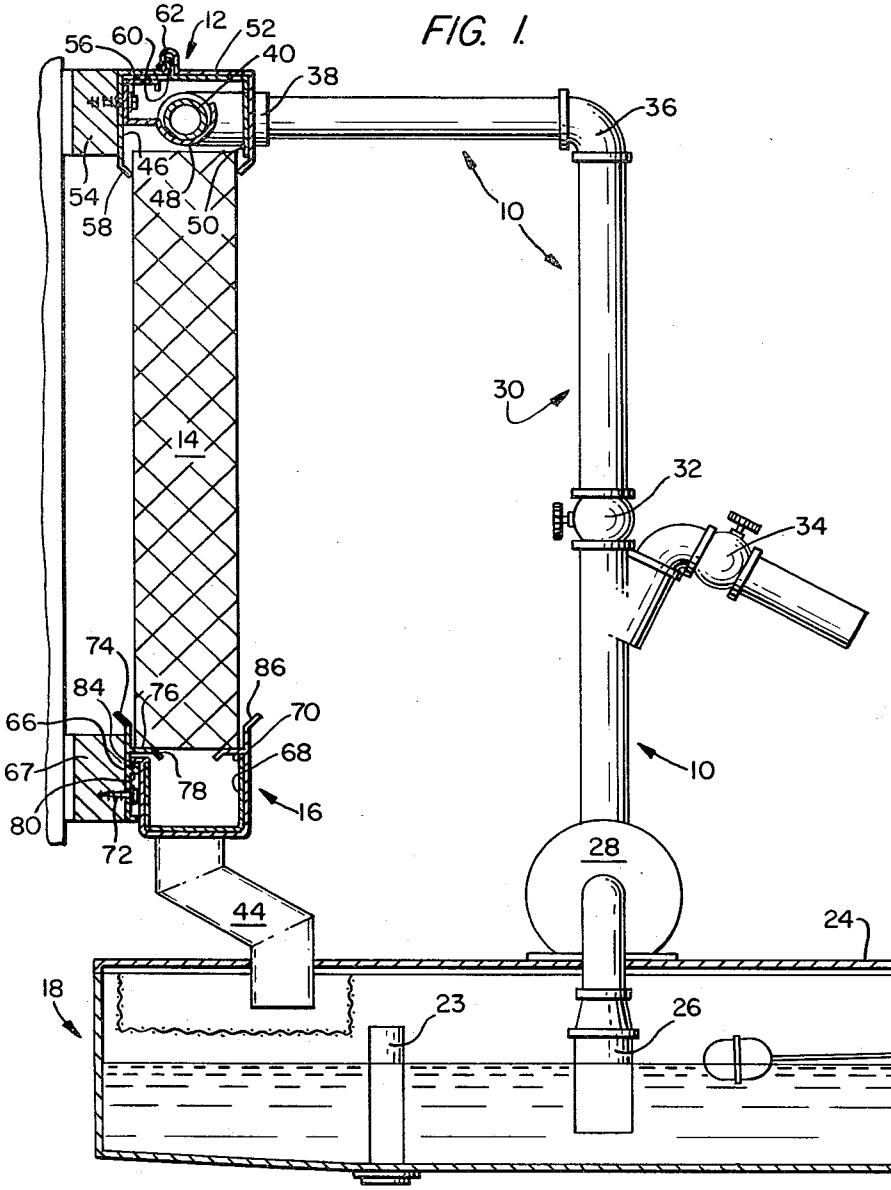
FIG. 1 is a side elevational view partly in section illustrating the cooling pad support assembly.

Reference is initially made to FIG. 1 which discloses the entire cooling pad system. It will be apparent that the entire cooling pad system includes a water conduit structure designated by the reference numeral 10, a cover assembly 12, a plurality of cooling pads 14, a gutter assembly 16, and a sump tank 18. Outside air is caused to rush through the water soaked pad 14 by the operation of one or more exhaust fans (not shown) and is cooled by the induced vaporization of the water.

To aid in the description of the invention, the path the moving water makes will be traced. As a point of reference, the path of travel of the cooling water will begin at the base of the water conduit structure 10.

The water conduit structure 10 begins at the sump tank 18 which is supplied with water through the supply line conduit 20. The supply line conduit 20 is provided with a float valve 22 for the purpose of maintaining a desired level of water in the sump tank 18. To compensate for the water level in the sump tank 18 exceeding the desired level for any purpose, an overflow pipe 23 is positioned in the sump tank 18. The sump tank 18 also contains a cover 24. An appropriate conduit structure 26 is employed to place the interior of the sump tank 18 in fluid communication with the pump 28 of the water conduit structure 20. Typically, the pump 28 is of the heavy duty, centrifugal, positive, self-priming type providing for high volume and relatively low head performance characteristics. Within the remaining conduit structue 10 are an ascending conduit structure 30, a flow control valve 32, a flush out valve 34, an elbow 36 and a "T" 38 which is operatively connected to a water conductor 40. The water conductor 40 terminates at one end in a plug (not shown) and terminates at the other end in a bleed-off apparatus to be described more fully hereinafter.

Figure 2:
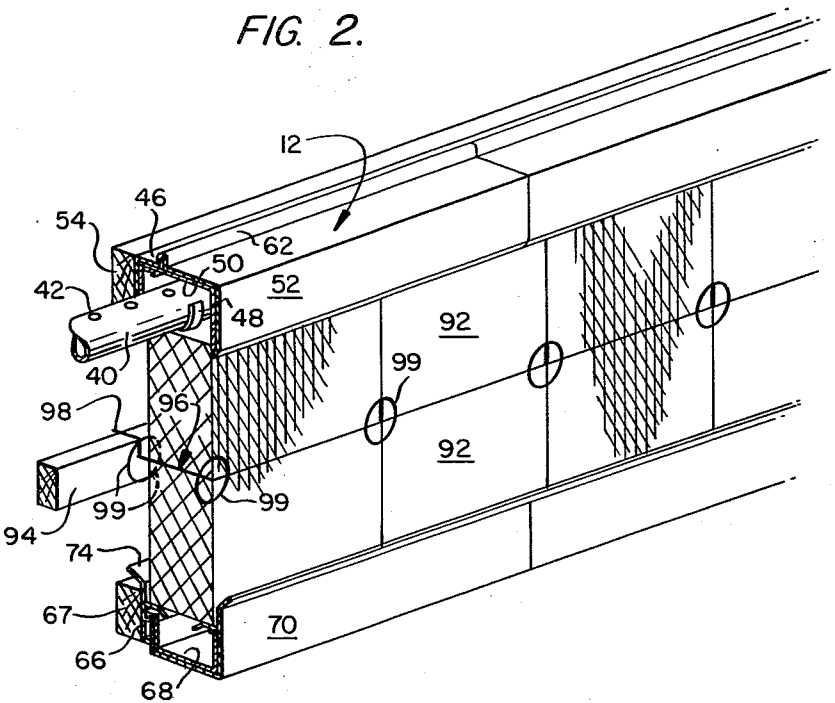
FIG. 2 is a perspective view of a portion of the cooling pad system illustrating in particular the arrangement of the top cover, pads, pad retainers and gutter assembly.

As best seen in FIG. 2, the water conductor 40 is provided throughout its upper surface length with a plurality of openings 42. Water sprays upwardly through the openings 42, contacts, is contained by, and is directed downwardly by the cover assembly 12 and passes downwardly through the pads 14 into the gutter assembly 16 and is thereafter returned to the sump tank 18 through the return conduit 44.

The general organization and function of the components of the cooling system of the present invention now being apparent, the detailed structure of the cooling pad support assembly attached to the wall of a building will now be described. Thereafter, instructions on how to easily install the cooling pad support assembly will be set out. For the purposes of further description a reference to "upwardly" means in a direction away from the floor of the building and "downwardly" means in a direction toward the floor of the building.

The cover assembly 12 includes top cover supports 46, water conductor support brackets 48, top cover connectors 50 and top covers 52.

The top cover supports 46 are attached continuously to a top stringer 54 by fastening means, for example, screws 56. It will be noted from FIG. 1 that each top cover support 46 is provided at its lower, vertical portion with a flange 58 extending outwardly at an angle toward, and contacting with, the pad 14. In addition, each top cover support 46 is provided at its upper horizontal portion with an upwardly perpendicular flange 60.

Water conductor support brackets 48 are intermittantly positioned along the top cover supports 46 by also using screws 56. The water conductor 40 rests on the support brackets 48 and appropriate connection is made with the "T" section 38.

It is to be noted that the openings 42 are located in both the water conductor 40 and the "T" 38. The openings 42 are on the upper surfaces of the water conductor 40 so that the water will spray upwardly for proper distribution throughout the cover assembly 12 above the surface of the pad 14.

The top cover connectors 50 are "L" shaped. The long sides of the "L"-shaped top cover connectors 50 are located between the top covers 52 and the drip conductor support brackets 48. The short sides of the "L"-shaped top cover connectors 50 extend in a downwardly direction. Top covers 52 fit over the top cover supports 46 and the top cover connectors 50 by interconnection of lips 62, located on the upper horizontal sides of the top covers 52, with the upright perpendicular flanges 60 of the top cover supports 46. The top covers 52 also include a vertical side having at its bottom a flange 64 extending inwardly toward, and contacting with, the pad 14, throughout the length of the pad 14. The cover assembly 12 terminates with top cover end caps (not shown).

As best seen in FIG. 1 the gutter assembly comprises gutter supports 66, gutter connectors 68 and gutters 70. The gutter supports 66 are attached to the bottom stringer 67 by means of, for example, screws 72. The gutter supports 66 comprise flanges 74 extending at an angle inwardly, horizontal pad support flanges 76 extending outwardly and terminating in flanges 78 extending at an angle downwardly, and flanges 79 extending outwardly and perpendicular from the vertical wall of the gutter supports 66. Beneath the horizontal pad support flange 76 is a groove 80.

Inside the walls of the "U"-shaped gutters 70 are gutter connectors 68 running continuously therethrough except at the downspout hole (not shown) where the downspout is positioned. The "U"-shaped gutter 70 has one side shorter than the other. The short sides of the gutter 70 terminate in a lip 84. The longer sides terminate in flanges 86 extending at an angle outwardly, and horizontal pad support flanges 88 extending inwardly and terminating in other flanges 89 extending at an angle inwardly. The gutters 70 are connected to the gutter supports 66 by inserting the lips 84 of the gutters 70 into the gutter support grooves 80. The respective ends of the gutter assembly 16 employ gutter end caps 81 connected by screws 82.

The above-described cooling pad gutter assembly may be used with one or more pads. When one desires to increase the cooling area by extending the height or length of the cooling pad system, individual cells 92 may be stacked vertically or horizontally to one another. The construction of the cooling cells 92 is explained in U.S. Pat. No. 4,031,180 which is hereby incorporated by reference.

Where more than one pad is used, intermediate stringer 94 is used at the intersection of the pads and pad retainers 96 are connected to the intermediate stringer 94, by means of a "hook" 98 extending over the intermediate stringer 94, as illustrated in FIG. 2. The pad retainers 96 terminate at the opposite end of the hook 98 in a ring 99. The use of pad retainers 96 is repeated until all of the pad retainers 96 necessary to secure the desired height and length of the individual cooling pads 92 have been fastened to the intermediate stringer 94.

A still further embodiment of the pad retainers includes a pad retainer similar to the one described above except that instead of just one ring 99 in the pad retainer there are two. A second ring 99 is placed closer to the "hook" so that the two rings 99 are spaced apart from each other a distance corresponding to the distance between the two faces of the cells such that the corners of the faces are held securely between said rings.

The installation and use of the above-referenced cooling pad support assembly will now be described. The entire cooling pad system should be placed on the opposite side of the building from the fans so that the cooled air may flow through the building without turbulence. The pads should be no more than 250 feet from the fans to avoid excessive temperature rises and velocities. In a greenhouse, the top of the pad should be near the top of the crop or have its midpoint centered on the midpoint of the crop. In poultry and livestock installations, the pad is generally placed on the outside of the building so that the top of the pad is not below the highest desired cooling level.

The building side wall structural members should be left intact. The stringers 54, 67 and 94 can be of any type of material (metal channels, rectangular square tubes, wood, etc.). The stringers should provide a flat surface for mounting support brackets and the bottom stringer 67 should be capable of carrying a pre-determined load, which in the case of the assignee's commercial product is 2.74 pounds per square foot of pad. The stringers 54, 67 and 94 must be sloped to a recommended one-half inch per ten feet to provide adequate run-off through the gutter assembly 16.

As pointed out above, when pads 14 over 48 inches are used, or when individual cells 92 are used, a third intermediate stringer 94 must be installed to prevent the taller one-piece pads 14 from bowing after a time and to prevent the two-piece pads 92 from separating.

A sump tank 18 should be provided with a capacity of ¾-gallon per square foot of pad area. A cover 24 should also be provided capable of supporting the pump 28 (between 35 and 50 pounds). The sump tank 18 should be set in place prior to start of the installation of the cover assembly 12 and gutter assembly 16.

Figure 3A:
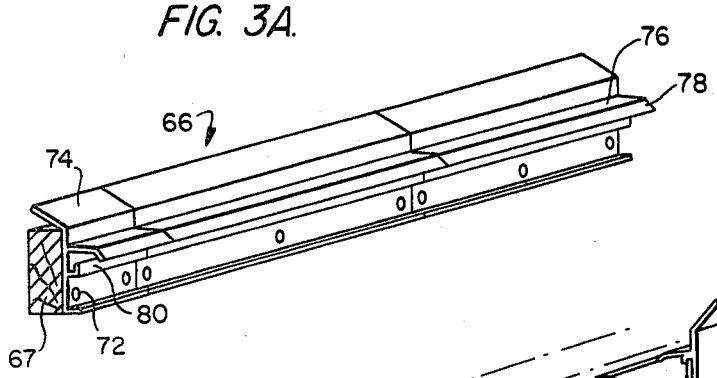
FIGS. 3A–3F are schematic illustrations of assembly of the components of the cooling pad support assembly.
Figure 3B:
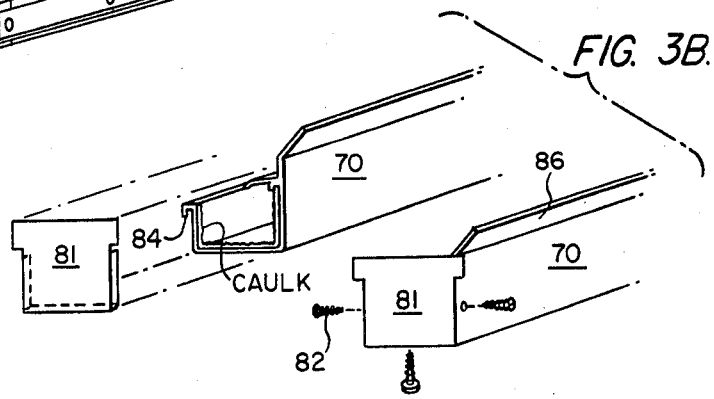

The gutter supports 66 should be located on the bottom stringer 67 by aligning the bottom of a gutter support a predetermined distance below the top of the bottom stringer 67 (which in the case of the assignee's commercial product is 3¼ inches) and attached with screws 72. See FIG. 3A. The gutter end caps are then installed in two gutters 70, one at opposite ends of each gutter 70, by securing with screws. These gutter sections are installed at opposite ends of the system. See FIG. 3B.

The downspout (not shown) is then installed in the gutter section with the downspout hole (not shown) by securing it with screws. This section is installed at the midpoint of the system over the sump tank 18.

Figure 3C:
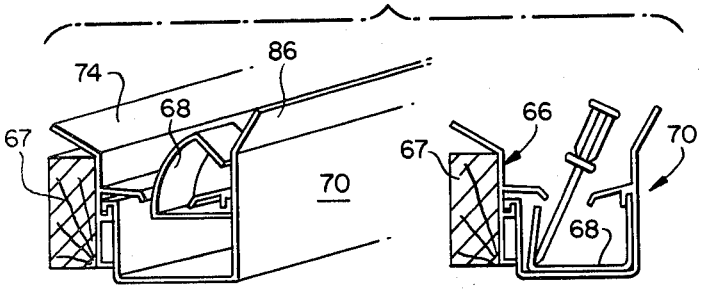

The gutter 70 is attached to the gutter support 66 by inserting the lip 84 of the short leg of the gutter 70 into the gutter support groove 80. The long leg of the gutter connector 68 is inserted under the long side of the gutter 70 and rotated downward. Installation of the gutter connector 68 is finished by pressing down on the short leg with a screwdriver. The short leg will then snap into position under the edge of the short leg of the gutter 70. See FIG. 3C.

The top surface of the joints between the gutter pieces 70 and the joints between the gutter supports 66 are caulked to prevent water from seeping through to the bottom stringer 67. A pad 14 is placed in the gutter assembly 16 to establish the position of the top cover supports 46 and water conductor support brackets 48. The water conductor support brackets 48 should be approximately one quarter-inch above the pad 14.

Figure 3D:
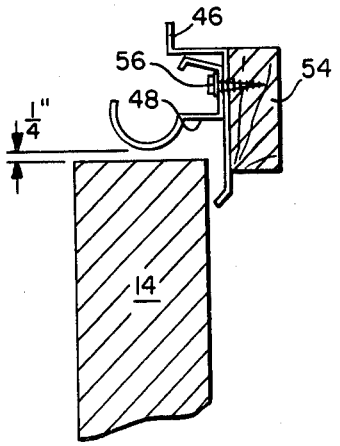

The top cover supports 46 and the drip conductor support brackets 48 are mounted on the top stringer 54 and secured with screws 56. See FIG. 3D. The joints of the top cover supports 46 are caulked so that water will not seep through to the top stringer 54.

A section of water conductor 40 is placed into the water conductor support bracket 48 near the mid-point of the system with the openings 42 pointing directly up, and the "T" 38 is connected to the water conductor 40. The remaining water conductors 40 are installed using couplings. The overall length of the water conductor 40 is then determined and the excess water conductor 40 is sawed off squarely approximately 1½ inches past the last of the top cover supports 46.

The top cover end cap (not shown) is slipped over the water conductor 40 such that the water conductor 40 is centered in the hole. The top cover end cap is attached to the top stringer 54 with screws 65.

The installation of a bleed-off apparatus will now be described. Such an apparatus is common in the art and is not shown in the figures. A 90-degree elbow is attached to the water conductor 40, and then a 2 foot section of PVC pipe is attached to the elbow. Next, a female adaptor is positioned on the pipe. The end of a pipe plug containing a fitting for bleed-off is screwed into the female adaptor. This pipe plug should be installed in the end nearest to a drain to provide the necessary bleed-off of water from the cooling pad system. A bleed-off connection and hose should be provided in the female adaptor. A hose is attached to the female adaptor to drain any bleed-off water outside the building or into a floor drain.

Figure 3E:
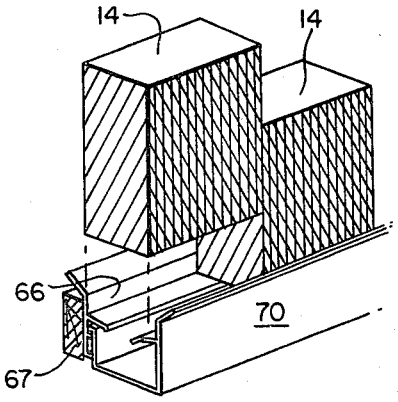

The pads 14 should now be installed by placing the pads into the gutter assembly 16. See FIG. 3E. The pads are pressed between the gutter flanges 74 and 86 and seated on the horizontal pad support flanges 76 and 88.

If several individual cells 92 are to be used, pad retainers 96 are used at the junction of each four pads 92. The bottom pad and the top pad are placed in position. The hook 98 of the pad retainer 96 is slipped over the intermediate stringer 94, then slid to the pads 92 that are in position. The next lower and upper pads 92 are placed into position and this procedure is continued until all pads are in position.

Figure 3F:
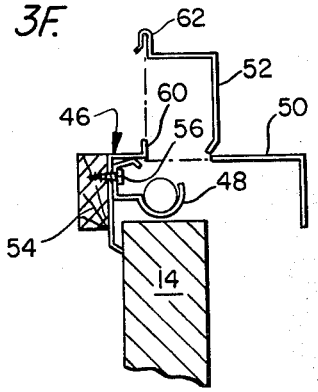

Finally, the top cover connectors 50 are installed by inserting the top cover connectors 50 between the top cover supports 46 and the water conductor support brackets 48. See FIG. 3F.

Before installing the top covers 52, start up and testing of the system may be performed. The water is tested for Ph level and soluable salts. The Ph should be between 6 and 9, and the salt concentration below 40,000 ppm. The water supply line 20 is opened to the sump tank 18. The float valve 22 is adjusted so the water shuts off before the water level in the sump tank 18 reaches the top of the overflow pipe 23.

The system should be flushed to clean out all accumulated debris, as follows:

(1) Remove plug 41 from the end of the water conductor 40.

(2) Open bleed-off apparatus.

(3) Open the flow valve 32 and close the flush out valve 34.

(4) Be sure pump 28 is primed prior to operation. Run power to pump 28 and let the system flush out for approximately 5 minutes.

(5) Shut the pump 28 off and replace the plug 41. Turn on the pump 28 and be sure the water is flowing from all openings 42 in the water conductor 40. Clean out any openings 42 that are not spraying water. Adjust the flow valve 32 until the water sprays approximately 4' in the air. Install the top cover connectors 50. The top covers 52 should now be installed by starting at each end and installing towards the "T" connection 38. The system is then ready for operation.

What is claimed is:

1. An improved cooling pad support assembly including a gutter positioned below the cooling cells along a bottom stringer in an opening within the wall of the building, at least one cooling cell, a water conductor provided with a plurality of openings therealong and positioned above the cooling cells along a top stringer in an opening within the wall of the building, a top cover over the water conductor, and a conduit connecting the gutter to the top cover, the improvement comprising:

a plurality of gutter supports having a first horizontal flange extending in a direction away from the wall and positioned continuously along the bottom stringer, a plurality of gutter sections connected to the plurality of gutter supports and having a second horizontal flange extending in a direction toward the wall, a plurality of gutter connectors lining the plurality of gutter sections, the bottom of the cooling pads resting on the first and second horizontal flanges of the plurality of gutter supports and gutter sections; and a plurality of top cover supports, a plurality of water conductor support brackets positioned in spaced relationship along the plurality of top cover supports, a plurality of top covers connected to the plurality of top cover supports to form a continuous wall above the water conductor, and a plurality of top cover connectors lining the plurality of top covers and positioned immediately above the water conductor, the vertical walls of the top cover supports and the top covers terminating at an angle in downwardly extending flanges that are spaced apart from each other a distance corresponding to the distance between the faces of the cells such that the top portions of the cells are held securely between the downwardly extending flanges.

2. An improved cooling pad support assembly as in claim 1, further comprising:

a stringer positioned intermediate of the top and bottom stringers, and a plurality of pad retainers connected to the intermediate stringer and spaced apart from each other distances corresponding to the width of each of the cooling cells.

3. An improved cooling pad support assembly as in claim 2, wherein the plurality of pad retainers have two ends; the first end terminating in a hook which fits over the intermediate stringer, and a second end which terminates in a ring.

4. An improved cooling pad support assembly as in claim 2, wherein the plurality of pad retainers have three portions; the first portion being a hook at one end of the pad retainer, the second portion being a first ring integrally formed in the pad retainer, and the third portion being a second ring integrally formed in the pad retainer; the first and second rings being spaced apart from each other a distance corresponding to the distance between the two faces of the cells such that corners of the faces of the cells are held securely between the rings.

5. An improved cooling pad support assembly including a gutter positioned below cooling cells along a bottom stringer at an opening within a wall of a building, at least one cooling cell, a water conductor provided with a plurality of openings therealong and positioned above the cooling cells and along a top stringer in an opening within a wall of a building, a top cover over the water conductor, and a conduit connecting the gutter to the top cover, the improvement comprising:

a plurality of gutter supports having a first horizontal flange extending in a direction away from the wall and positioned continuously along the bottom stringer, a plurality of gutter sections connected to the plurality of gutter supports and having a second horizontal flange extending in a direction toward the wall, a plurality of gutter connectors lining the plurality of gutter sections, the bottom of the cooling pads resting on the first and second horizontal flanges of the plurality of gutter supports and gutter sections, a plurality of pad retainers having a first and a second end, the first end terminating in a hook which fits over the intermediate stringer, and the second end terminating in a ring, and a plurality of top cover supports, a plurality of water conductor support brackets positioned in spaced relationship along the plurality of top cover supports, a plurality of top covers connected to the plurality of top cover supports to form a continuous wall above the water conductor, and a plurality of top cover connectors lining the plurality of top covers and positioned immediately above the water conductor, the vertical walls of the top cover supports and the top covers terminating at an angle downwardly in flanges that are spaced apart from each other a distance corresponding to the distance between the faces of the cells such that the top portions of the cells are held securely between the downwardly extending flanges.

6. An improved cooling pad support assembly as in claim 1 or 5, wherein each gutter support comprises a first portion having a top and a bottom abutting the bottom stringer, a second portion extending outwardly from the top of the first portion at substantially a right angle and terminating in a flange extending at an angle downwardly, a third portion extending at an angle inwardly from the top of the first portion, and a fourth portion extending outwardly at substantially a right angle and then upwardly at substantially a right angle to form a groove in the first portion intermediate of the top and bottom of the first portion.

7. An improved cooling pad support assembly as in claim 1 or 5, wherein each gutter section is "U"-shaped and comprises three portions; a first portion parallel to the wall of the building and terminating inwardly toward the wall at substantially a right angle and then downwardly at substantially a right angle to form a hook in the first portion, a second portion perpendicular to and extending outwardly from the first portion, and a third portion extending upwardly, parallel and opposite to the first portion and having a first flange extending inwardly from the third portion at substantially a right angle and terminating in a second flange extending at an angle downwardly and the third portion terminating in a third flange extending at an angle outwardly from the wall.

8. An improved cooling pad support assembly as in claim 1 or 5, wherein each top cover support comprises a first portion having a top and bottom abutting the top stringer, the bottom terminating in a flange extending at an angle outwardly from the wall and a second portion extending outwardly at substantially a right angle from the top of the first portion and terminating in a flange extending upwardly at substantially a right angle from the second portion.

9. An improved cooling pad support assembly as in claim 1 or 5, wherein each top cover connector is "L"-shaped.

10. An improved evaporative cooing pad support assembly as in claim 1 or 5, wherein each top cover comprises a first portion parallel and opposite the top stringer and having a top and bottom, the bottom terminating in a flange extending at an angle inwardly toward the wall, and a second portion extending inwardly from the top of the first portion at substantially a right angle and terminating in a hook extending upwardly from the second portion at substantially a right angle and continuing downwardly.

* * * * *